United States Patent [19]

Deschamps et al.

[11] Patent Number: 4,770,555

[45] Date of Patent: Sep. 13, 1988

[54] PRINTING MACHINE EQUIPPED WITH A DEVICE FOR THE SELECTIVE SUPPLY OF SHEETS FROM TWO FEED TRAYS

[75] Inventors: Jean-Pierre Deschamps, Quevilly; Benoît Bizet, Cergy; Jean-Michel Ciccone, Osny, all of France

[73] Assignee: Societe d'Applications Generales d'Electricite et de Mecanique Sagem, Paris, France

[21] Appl. No.: 32,722

[22] Filed: Apr. 1, 1987

[30] Foreign Application Priority Data

Apr. 8, 1986 [FR] France ..... 86 04978

[51] Int. Cl.[4] ..... B65H 3/44

[52] U.S. Cl. ..... 400/624; 400/629; 271/9

[58] Field of Search ..... 400/624, 628, 629; 271/9

[56] References Cited

U.S. PATENT DOCUMENTS 4,564,187 1/1986 Costa et al. ..... 271/9

FOREIGN PATENT DOCUMENTS 0184633 6/1986 European Pat. Off. ..... 400/624
3317910 12/1983 Fed. Rep. of Germany ..... 271/9
1160164 7/1969 United Kingdom ..... 271/9

*Primary Examiner*—David Wiecking
*Assistant Examiner*—James Lisehora
*Attorney, Agent, or Firm*—Larson & Taylor

[57] ABSTRACT

The printing machine comprises a device for the supply of sheets. This device is constituted in the form of a removable unitary module comprising means for taking-up motion. Selection means are provided and comprise motion distributing means associated with said take-up means to direct the motion to means for extraction of sheets.

6 Claims, 2 Drawing Sheets

PRINTING MACHINE EQUIPPED WITH A DEVICE FOR THE SELECTIVE SUPPLY OF SHEETS FROM TWO FEED TRAYS

BACKGROUND OF THE INVENTION

The present invention relates to improvements in or to the portion of a printing machine for supplying sheets to be printed, and more particularly the invention relates to a printing machine comprising a device for the supply of sheets to be printed with at least two removable feed trays containing the sheets to be printed, extraction means, driven by a single principal motor, to extract the sheets from one of the trays and to propel them in the machine to the printing means, as well as selection means to cause the extraction means to cooperate selectively with one of these trays.

It is customary at present, to equip printing machines or the like with two trays for sheets to be printed, either to facilitate the supply of the machine with a sheet of the same type, or to use selectively sheets of different characteristics (formats and/or colors particularly).

Systems for the extraction of sheets from feed trays and for the selection of the appropriate tray are, in these known machines, driven by an electric motor this special purpose, that is to say, which is different from motors for advancing and printing sheets particularly; a motor with two directions of rotation is associated with a transmission train including two free wheels so as to drive selectively rollers for selecting sheets or starting rolls respectively in the two trays. The motor used has a very high rotary speed, so that the motion-transmitting gears also rotate fast, whence the generation of considerable noise: in addition, the pinions, to be sufficiently strong, must be metallic, which increases their cost and, taking into account the high speeds of rotation, they must be mounted on ball bearings or the like, whence an additional increase in costs.

SUMMARY OF THE INVENTION

It is a particular object of the invention to overcome the drawbacks presented by these known printing machines, and to construct the device for the selective supply of sheets so as to reduce its cost and to render it more silent in operation. It is also an object of the invention to improve thereby access to the different parts of the device for the selective supply of sheets, and even to the parts of the rest of the printing machine, so that the maintenance and possible replacement of parts are thereby facilitated, simplified and hence less laborious.

Accordingly, a printing machine arranged according to the invention is characterized in that the device for the supply of sheets for printing is constituted in the form of a removable unitary module and comprises in addition means for taking up motion which are adapted to cooperate by simple contact with a rotary member driven by the abovesaid principal motor situated outside the supply device, in the remaining part of the printing machine, and which are arranged in addition to transmit this motion to the inside of the device, and wherein the abovesaid selection means comprise distributing means for movements associated with said means for taking up and transmitting motion to direct the motion to the means for sheet extraction from the selected tray and drive means to actuate said distributing means so that the latter can occupy at least three positions, namely at least two operational positions in which they cooperate selectively respectively with the means for extraction from the two trays and a neutral position in which they cooperate with none of the means for extraction from the trays.

The arrangement according to the invention enables the need for a specific motor for the taking up of sheets from the feed trays to be dispensed with, whence a further source of considerable economies.

In addition, the arrangement of the device in the form of a removable module procures, after extraction of the latter from the printing machine, a greater facility of access to the mechanisms and simplifies the work of maintenance. A damaged device can immediately be replaced and the machine thus only undergoes stoppage for a short period. In addition, the maintenance of the rest of the printing machine can be facilitated thereby, since the extraction of the module provides easy access to the other internal components. Finally, this arrangement multiplies the operational possibilities of the machine, since it is possible to provide modules of different types, equipped, for example, for sheets of particular format and/or composition.

It is particularly advantageous for the taking up of the necessary motion to be done on a rotary member forming part of the mechanism for moving the sheets line by line in the course of the printing and for the aforesaid principal drive motor be the inter-line motor actuating this mechanism: in fact, such a motor rotates very slowly (for example one revolution per second) and the drive mechanism can then be constructed by means of gears and parts of plastics material, obtained by molding, and hence inexpensive: in addition, the whole operates with an extremely low noise level; finally, this unity of the drive means for the extraction of the sheets from the trays and movement of the sheets in the course of printing before the printing means results in a synchronism for the advance of the sheets throughout their passage from the storage tray to the outlet from the printing machine after printing.

In order to render less critical the tolerances of positioning the module in the printing machine, it is advantageous for the means for taking up the movement to be able to cooperate by simple contact and without precise adjustment with the rotary member fast to the motor. To this end, it is possible to provide for the means for taking up and transmitting movement to comprise an arm, projecting at least partly outside the device for supplying sheets and articulated in rotation on said device; a motion take-up wheel, borne by the free end of the arm, adapted to cooperate with the rotary member of the mechanism for driving sheets into the printer; endless belt supported by two pullies or the like, one of which is coaxial with the movement take-up wheel and fast to the latter in rotation and the other of which is coaxial with the axis of articulation of the arm on the device; and elastic return means associated with the arm arranged so that the movement take-up wheel is applied elastically between the rotary member.

In a preferred embodiment, the distributing means comprise a balance wheel supported for rotation coaxially with the articulation axle of the arm and bearing at least one satellite wheel which coacts with a driven wheel, fast to the support pulley of the coaxial endless belt, coaxial with the articulation axle of the arm and which is adapted to come into contact selectively with one or other of the means for extraction of sheets from the trays.

Advantageously, the drive means for the actuation of the balance arm comprise a drive member coupled to the pivoting balance wheel and an electric motor of which the output shaft cooperates in rotation with the circular actuate edge of the drive member of the balance wheel.

In the case of a printing machine equipped with two trays, the balance wheel advantageously supports two satellite wheels adapted to cooperate selectively with the sheet extraction means associated respectively with the two trays and the electric motor can be actuated in both directions of rotation to result in the cooperation of the balance wheel respectively with one or other tray.

The invention will be better understood on reading the detailed description which follows of a preferred embodiment given purely by way of non-limiting example; in this description reference is made to the drawing in which:

DESCRIPTION OF THE PREFERRED EMBODIMENTS

Figure 1:
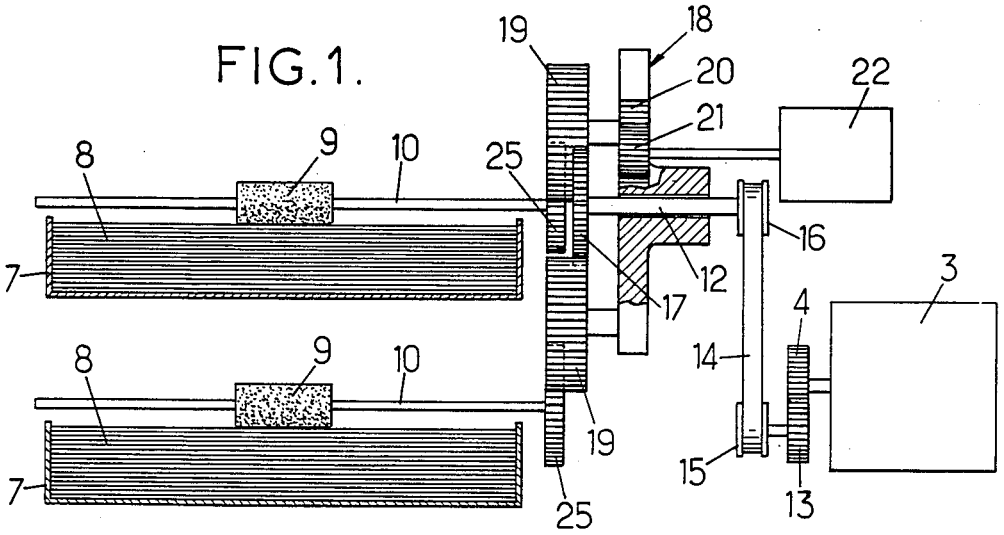
FIGS. 1 and 2 are diagrammatic representations respectively in partial front view and side view, of a printing machine part arranged according to the invention.
Figure 2:
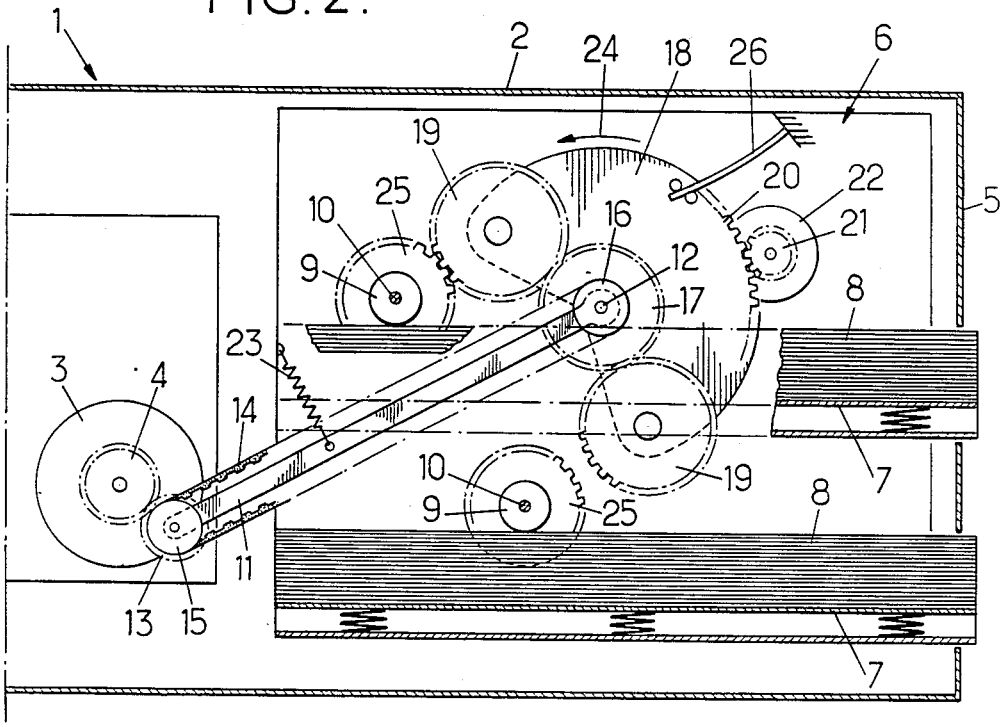

Referring now first more specifically to FIGS. 1 and 2, is shown a portion (in general the rear portion or a side portion) of a printing machine 1 denoted by its casing 2, the part concerned of the machine being that where the reserve of sheets to be printed (for example, sheets of paper) is to be found. Of the rest of the machine there are shown diagrammatically only the motor 3 or the interlinear motor designed to move a sheet (not visible) before the printing means line by line (not shown), as well as a gear wheel 4 fixed to the axle of this motor.

The rear or lateral surface 5 of the casing 2 is dismountable to yield passage (positioning or extraction) to a module device 6 for the supply of sheets constituted in the form of a removable module. The device 6 is arranged to support, in any manner known in itself for this purpose, two trays 7 superimposed and charged with sheets 8, the trays being removable through corresponding openings of the face 5. Above each tray is situated a detachment roller or wheel 9, fixed to an axle 10, driven in rotation, which extracts the sheet 8 situated on the top of the corresponding pile.

To drive the appropriate roller 9, recourse is had to the following means. Device 6 is provided with an arm 11, projecting partially outside, which at its inner end (right-hand end in FIG. 2), is mounted to pivot on an axle 12. At its other end, (left hand end in FIG. 2), the arm 11 bears a gear wheel 13 adapted to cooperate with the gear wheel 4 driven by the motor 3. In addition, an endless link, such as a notched belt 14, is supported on one side by a pulley 15 coaxial with the wheel 13 and fast in rotation with the latter and by a pulley 16 rotating loose on the axle 12 of the opposite end of the arm. A gear wheel 17 is mounted on the axle 12 and is fast in rotation with the pulley 16. In addition, a balance wheel 18 is also supported to rotate freely on the axle 12, this balance wheel having the shape of a circular sector centered on the axle 12 and supporting at its two ends two loose gear wheels or satellite wheels 19 enmeshing with the gear wheel 17. The circular periphery, or a portion of the latter, of the balance wheel 18 is toothed (at 20) to cooperate with a gear wheel 21 driven by a motor 22 with two directions of rotation controlled by a suitable selection means (commutator-reversor) (not shown).

In the operating position of the printing machine shown in the figures, the gear wheel 13 borne by the outer end of the arm 11 is held supported against the leading gear wheel 4 under the action of an elastic return force due to a spring 23 inserted between the arm 4 and a fixed part of the device. The motion is thus transmitted to the gear wheels 19 which are driven permanently.

The selection of the upper tray 7 or lower tray is effected by controlling the appropriate direction of rotation of the selection motor 22 which drives the balance wheel 18; for example in the direction of the arrow 24, as shown in the Figures, to bring the upper gear wheel 19 into contact with a gear wheel 25 fixed to the upper shaft 10 (the lower gear wheel 19 then being disengaged from the gear wheel 25 fixed to the lower shaft 10): it is then the sheets 8 from the upper tray which are delivered to the printing machine during the printing.

The selection of the lower tray is done by reversing the direction of rotation of the motor 22 so as to disengage the upper wheels 25 and 19 and to cause the lower wheels 25 and 19 to cooperate.

In addition, a return spring 26 is associated with the balance wheel 18 to bring back the latter into neutral position in the absence of a command from the selection motor 22: the wheels 25 and 19 both lower and upper no longer cooperate.

In the assembly which has just been described with reference to FIGS. 1 and 2, it is observed that, for a given direction of rotation of the wheel 17, the cooperation of one or other of the satellite wheels 19 with the corresponding wheels 25 is not performed identically: for one of the pairs of wheels 19–25, this cooperation is "engaging" (that is to say the forces which are exerted on the satellite wheel 19 tend to force the latter into its contact with the wheel 25), whilst for the other pair of wheels 19–25 this cooperation is "disengaging" (that is to say the forces which are exerted on the satellite wheel 19 tend to separate the latter from contact with the wheel 25). Consequently, it is necessary for the motor 22 to generate sufficiently high torque to maintain the required engagement of the wheel 19 with the wheel 25, including here the case of "disengaging" cooperation, which risks resulting in excessive fatigue of the motor and its rapid wear or the overdimensioning of the motor which is then more laborious.

Figure 3:
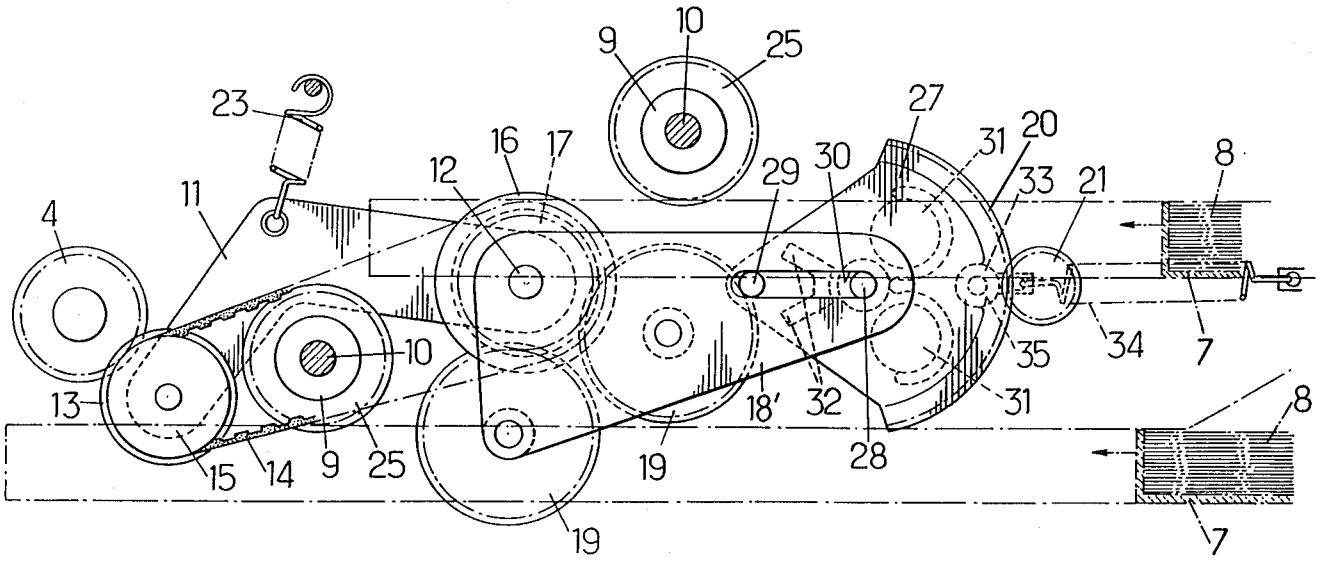
FIG. 3 is partial side view of a machine portion arranged according to the invention, constituting a modification of the arrangement of FIG. 2.

To overcome this drawback, it is proposed to provide the modification of the embodiment shown in FIG. 3 (in which the same reference numerals denote parts identical with those of the device of FIGS. 1 and 2). In this embodiment, the gear wheel 21 of the motor 22 acts on the balance wheel 18, not directly, but through a pivoting drive member 27. The member 27 is shaped as a circular sector mounted freely on its central axle 28 and enmeshing, through its toothed edge of circular arcuate form 20, with the leading wheel 21. Opposite the toothed edge 20, the drive member 27 bears a finger 29 projecting laterally and engaged in an elongated aperture 30 of one portion facing the balance wheel 18'. In addition, the member 27 is provided with stop studs 31 projecting laterally adapted to come against corresponding fixed stops 32 (for example borne by the frame). Finally a stop 33, rectractable on encountering a return force due to a spring 34, can be engaged in a notch 35 of the drive member 27 to materialize the neutral position (position shown in FIG. 3). Generally, the arrangement is such that the pivoting axle 12 of the arm 11, the pivoting axle 28 of the drive member 27 and the axle of the gear wheel 21 are aligned, the axle of the finger 29 being also situated in this alignment in the neutral position of the device.

In the embodiment which has just been described, the rotation of the wheel 21 causes the pivoting of the member 27 which, in its turn, through the finger 29 engaged in the aperture 30, causes the tilting of the balance wheel 18' in the appropriate direction. The reaction forces to which the balance wheel 18' is subjected are taken up and compensated by the drive member 27, and the motor 22 then has only to provide a relatively weak maintenance torque, permitting the use of a motor of low power.

Taking into account the rotary speed (of the order of 1 rotation per second) of the interlining motor 3, the whole of the kinematic chain of the device 6 itself also operates at low speed and hence remains silent. Another consequence of this low speed is the possibility of resorting to gear wheels of plastics material less expensive and less noisy than metallic gear wheels. In addition, resorting to an elastic return arm 11 ensures efficient cooperation of the gear wheels 4 and 13, whatever the longitudinal position (within a certain range) of the device 6 with respect to the motor 3, which renders the tolerances of said positioning less critical.

In addition, this arrangement enables an economy to be effected in the motor traditionally allocated to the extraction of the sheets from the trays.

Finally, this arrangement procures a synchronization of the advance of the sheets both on their extraction from the tray and on their passage before the printing means of the printing machine.

While preferred embodiments of the present invention have been illustrated and described, it will be apparent to those skilled in the art that modifications can be made within the scope of the invention which is defined in the appended claims. Accordingly, the foregoing embodiments are to be considered as illustrative only, rather than restricting the invention and those modifications which come within the meaning and range of equivalency of the claims are to be included herein.

We claim:

1. A printing machine in combination with a removable module adapted to contain sheets to be printed, said printing machine having a single principal motor drivingly connected to a rotary member, said module having a support member;

at least two removable trays supported on said support member, said trays being adapted to contain sheets to be printed; at least one extraction means supported on said support member adjacent each of said trays and being adapted to engage and move said sheets out of said trays to said printing machine;

a motion transmission means adapted to cooperate with said rotary member to transmit motion therefrom to one or the other of said extraction means inside of said module, said transmission means including motion distributing means rotatably supported about a pivot axis on said support member and being adapted to drivingly engage said extraction means;

a first pulley rotatably mounted coaxially with said pivot axis of said motion distributing means;

an elongated arm pivotally mounted at one end coaxially with said pivot axis of said motion distributing means and having its other end extending outside of said module toward said principal motor;

a second pulley rotatably mounted on said other end of said arm coaxially with a drive wheel which is adapted to engage said rotary member;

an endless belt connecting said first pulley to said second pulley;

drive means supported by said support member and drivingly connected to said motion distributing means to rotate it in one direction to engage it with one extraction means and to rotate it in an opposite direction to engage it with the other extraction means; and means supported by said support member to elastically urge said drive wheel against said rotary member of said printing machine.

2. The invention of claim 1, wherein said motion distributing means comprises a balance wheel supported for rotation coaxially with said pivot for said elongated arm, a driven wheel fastened to said first pulley, at least one satellite wheel rotatably supported on said balance wheel and being drivingly engaged with said driven wheel and being adapted to drivingly engage said extraction means.

3. The invention of claim 2, wherein said drive means for the rotation of said balance wheel comprise a drive member coupled to said balance wheel and shaped as a pivoting circular sector having an arcuate edge, an electric motor, the output shaft of which cooperates in rotation with said arcuate edge of said drive member.

4. The invention of claim 3, wherein said module comprises two trays, said balance wheel supports two satellite wheels adapted to cooperate selectively with said extraction means for said sheets, and said electric motor adapted to be actuated in both directions of rotation.

5. The invention of claim 1, wherein elastic return means are supported on said support member to bring back said motion distributing means to a neutral position, wherein said motion distributing means is not engaged with either extraction means, when said drive means for said distributing means is not in operation.

6. A printing machine in combination with a removable module adapated to contain sheets to be printed, said printing machine having a single principal motor drivingly connected to a rotary member, said module means having a support member;

at least two removable trays supported on said support member, said trays being adapted to contain sheets to be printed;

extraction rollers rotatably supported on said support member adjacent each of said trays, respectively, and being adapted to engage and move said sheets out of said trays to said printing machine;

a motion transmission means adapted to cooperate with said rotary member to transmit motion therefrom to one or the other of said extraction rollers inside of said module, said transmission means including a balance wheel rotatably supported on said support member;

satellite wheels rotatably supported on said balance wheel;

a first pulley rotatably mounted coaxially with said balance wheel and being drivingly engaged with said satellite wheels;

an elongated arm pivotally mounted at one end coaxially with said balance wheel and having its other end extending outside of said module toward said principal motor;

a second pulley rotatably mounted on said other end of said arm and being adapted to be drivingly engaged by said rotary member;

an endless belt connecting said first pulley to said second pulley;

a motor means supported by said support member and drivingly connected to said balance wheel to rotate it in one direction to engage one satellite wheel with one extraction roller and to rotate it in an opposite direction to engage the other satellite wheel with the other extraction roller; and means supported by said support member to elastically urge said second pulley toward said rotary member of said printing machine.

* * * * *